US006536816B1

(12) United States Patent
Fan

(10) Patent No.: US 6,536,816 B1
(45) Date of Patent: Mar. 25, 2003

(54) ADJUSTABLE DOOR LOCK CORE

(76) Inventor: Fang-Chang Fan, No. 124, Pateh Rd., Jiayih City (TW)

( * ) Notice: Subject to any disclaimer, the term of this patent is extended or adjusted under 35 U.S.C. 154(b) by 0 days.

(21) Appl. No.: 10/086,720

(22) Filed: Mar. 4, 2002

(51) Int. Cl.[7] ..... E05C 1/00
(52) U.S. Cl. ..... 292/337; 292/1.5; 292/DIG. 53
(58) Field of Search ..... 292/337, 1.5, 169.13, 292/DIG. 53, DIG. 60

(56) References Cited

U.S. PATENT DOCUMENTS 4,718,706 A * 1/1988 Fang ..... 292/337
4,729,586 A * 3/1988 Fang ..... 292/337
4,746,154 A * 5/1988 Fang ..... 292/337
6,318,769 B1 * 11/2001 Kang ..... 292/1.5

FOREIGN PATENT DOCUMENTS

GB 2115053 * 9/1983 ..... E05C/1/00
GB 2115057 * 9/1983 ..... E05C/1/00

* cited by examiner

*Primary Examiner*—Gary Estremsky
(74) *Attorney, Agent, or Firm*—Troxell Law Office PLLC

(57) ABSTRACT

A door lock core is composed of a latch part, an operating part and a barrel. The latch part is received in the barrel and has a disk with a slot rotatably mounted at a rear end of the barrel. The latch part has a first latch plate extending through the slot and a latch bolt provided at a front end of the first latch plate. The operating part is provided at a rear side of the disk and has a pull plate extending through the slot. The pull plate has a hook attached to the first latch plate and assembled between two side plates. The side plates each have a positioning hole in alignment with each other and a hook attached in the slot. A ring is rotatably mounted at a front end of the barrel and the latch bolt extends out through the ring.

4 Claims, 8 Drawing Sheets

ADJUSTABLE DOOR LOCK CORE

BACKGROUND OF THE INVENTION

1. Field of the Invention

The present invention is related to a door lock, and more particularly to a core of the door lock which can be conveniently adjusted during installation.

2. Description of Related Art

A door lock core is generally composed of a barrel, a latch part securely received in the barrel, and an operating part assembled with the latch part. For installation of a door lock, a door has a transverse lockhole and a lateral hole communicated with the lockhole. The barrel is received in the lateral hole and the operating part is received in the lockhole. The operating part has positioning holes which must be perpendicular to a front height of the door. It is impossible to install the lock core in the correct position in one time, so that the adjustment is required.

However, after being received in the lateral hole, the barrel is secured in the door and it is difficult to turn the barrel for a further adjustment.

Referring to FIGS. 7 and 8, an adjustable lock core (60) has a latch part (61), an operating part (62) and a barrel (63). The latch part (61) is mounted in the barrel (63) and assembled with the operating part (62). The operating part (62) has positioning holes (621) defined therein. The adjustable lock core (60) further has a sleeve (64) provided outside the barrel (63). The sleeve (64) has a plurality of teeth (not numbered) formed on an outer periphery thereof.

During installation, the sleeve (64) is inserted in a lateral hole (71) of a door (70) and secured in the door by the teeth which cut into a periphery defining the lateral hole (71). The barrel (63) is received in the sleeve (64) and rotatable about the sleeve (64). Thus, the operating part (62) can be adjusted by turning the barrel (63) to make the positioning holes (621) align with a transverse lockhole into which a handle may extend.

However, because the sleeve (64) is an additional element in the door lock core, an overall cost of the door lock is high. Moreover, as it is a separate element, a user often forgets to install the sleeve (64) before the barrel (63) is inserted in the lateral hole (71) which results in considerable inconvenience and irritation.

Therefore, the invention provides an improved door lock core to mitigate and/or obviate the aforementioned problems.

SUMMARY OF THE INVENTION

The main objective of the invention is to provide a door lock core which can be conveniently assembled.

Another objective of the invention is to provide a door lock core which has a low cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
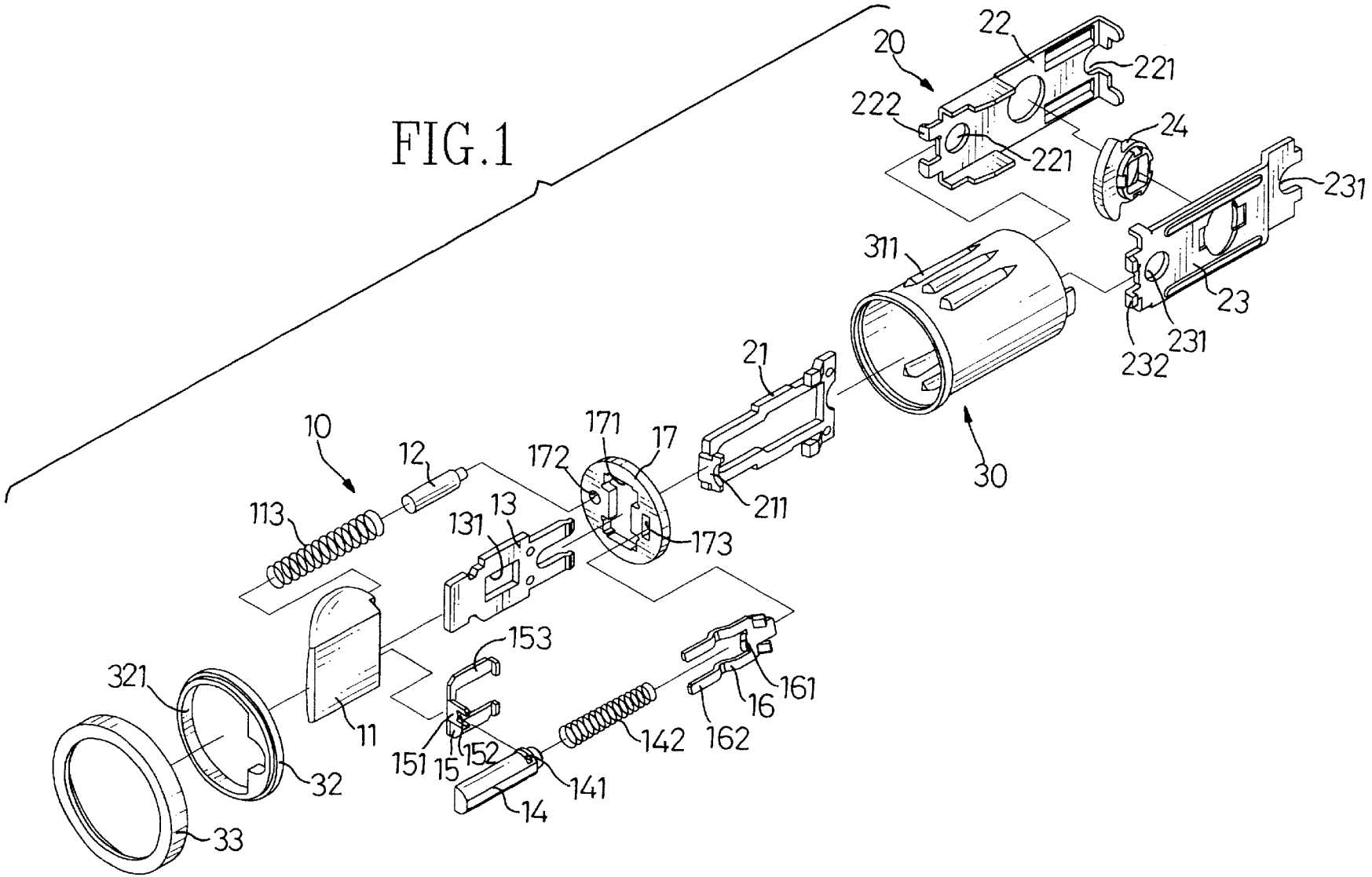
FIG. 1 is an exploded perspective view of a tubular door lock in accordance with the invention.

Referring to FIG. 1, a lock core in accordance with the invention is composed of a latch part (10), an operating part (20), and a barrel (30).

Referring to FIGS. I and 2, the latch part (10), which is received in the barrel (30), has a latch bolt (11) provided at a front end of the barrel (30). The latch bolt (11) has a slope (not numbered) formed at an outer end thereof and a pole (111) formed at an inner end thereof. A hole (112) is defined in the latch bolt (11) for a first latch plate (13) inserted therein. The first latch plate (13) has an opening (131) defined therein and extends through an I-like slot (171) defined at a center of a disk (17). The disk (17) further has a first aperture (172) and a second aperture (173) respectively defined at two sides of the slot (171). A rod (12) is inserted in the first aperture (172) and a first resilient member (113) is mounted between the pole (111) and the rod (12).

A dead bolt (14) is parallel to the latch bolt (11) and has a recess (141) defined at an inner end thereof. A second latch plate (15) has an ear (151) with a notch (152) and two short arms (153) extending backwards and abutting the first latch plate (13). The dead bolt (14) is mounted in the ear (151) with the recess (14) received in the notch (152). A third latch plate (16) in alignment with the dead bolt (14) has two long arms (162) extending forwards and a butt (161) formed between the long arms (162). A second resilient member (142) is mounted between the dead bolt (14) and the butt (161).

The operating part (20) is provided at the rear side of the disk (17) and includes a pull plate (21), a first side plate (22), a second side plate (23), and a cam (24). The pull plate (21) extends through the slot (171) and has a first hook (211) formed at a front end thereof and attached in the opening (131) of the first latch plate (13). The first and second side plates (22, 23) are assembled together to cover the pull plate (21) and the cam (24) inside. A second hook (222) and a third hook (232) are respectively formed at front ends of the first and second side plates (22, 23) and attached to the slot (171). Thus, the operating part (20) is secured to the latch part (10). The first side plate (22) further has a first positioning hole (221), and the second side plate (23) has a second positioning hole (231) in alignment with the first positioning hole (221).

The barrel (30) has a tubular body (31) with a plurality of teeth (311) formed on an outer periphery thereof. A flange (312) is formed at a rear end of the tubular body (31). When the latch part (10) is received in the tubular body (31), the disk (17) is rotatably abutted the flange (312). The operating part (20) extends out from the rear end of tubular body (31). A ring (32) is rotatably mounted at a front end of the tubular body (31) and has a through hole (321) defined therethrough for the latch bolt (11) and the dead bolt (14) extending out from the ring (321). A collar (33) is secured at the front end to prevent the ring (32) from escaping.

Therefore, the latch part (10) and the operating part (20) are rotatably mounted in the barrel (30).

Figure 2:
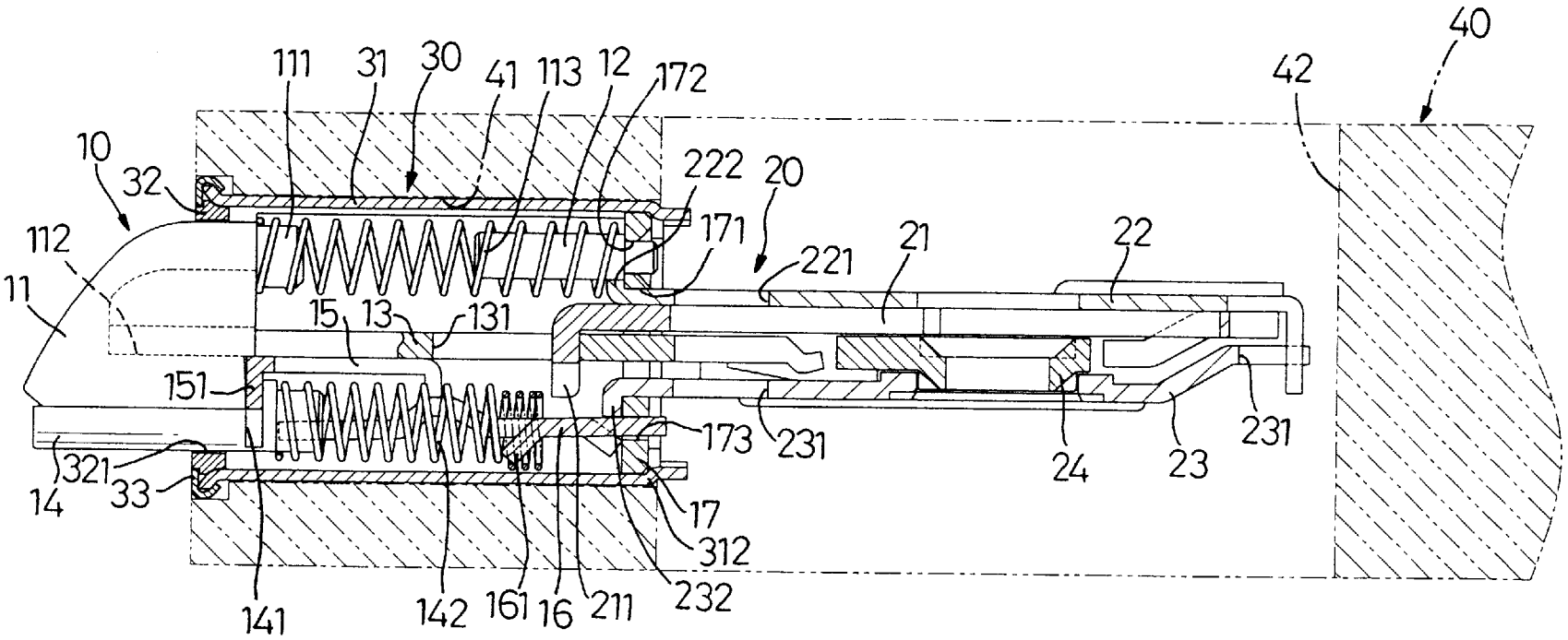
FIG. 2 is a cross sectional view of the tubular door lock.
Figure 3:
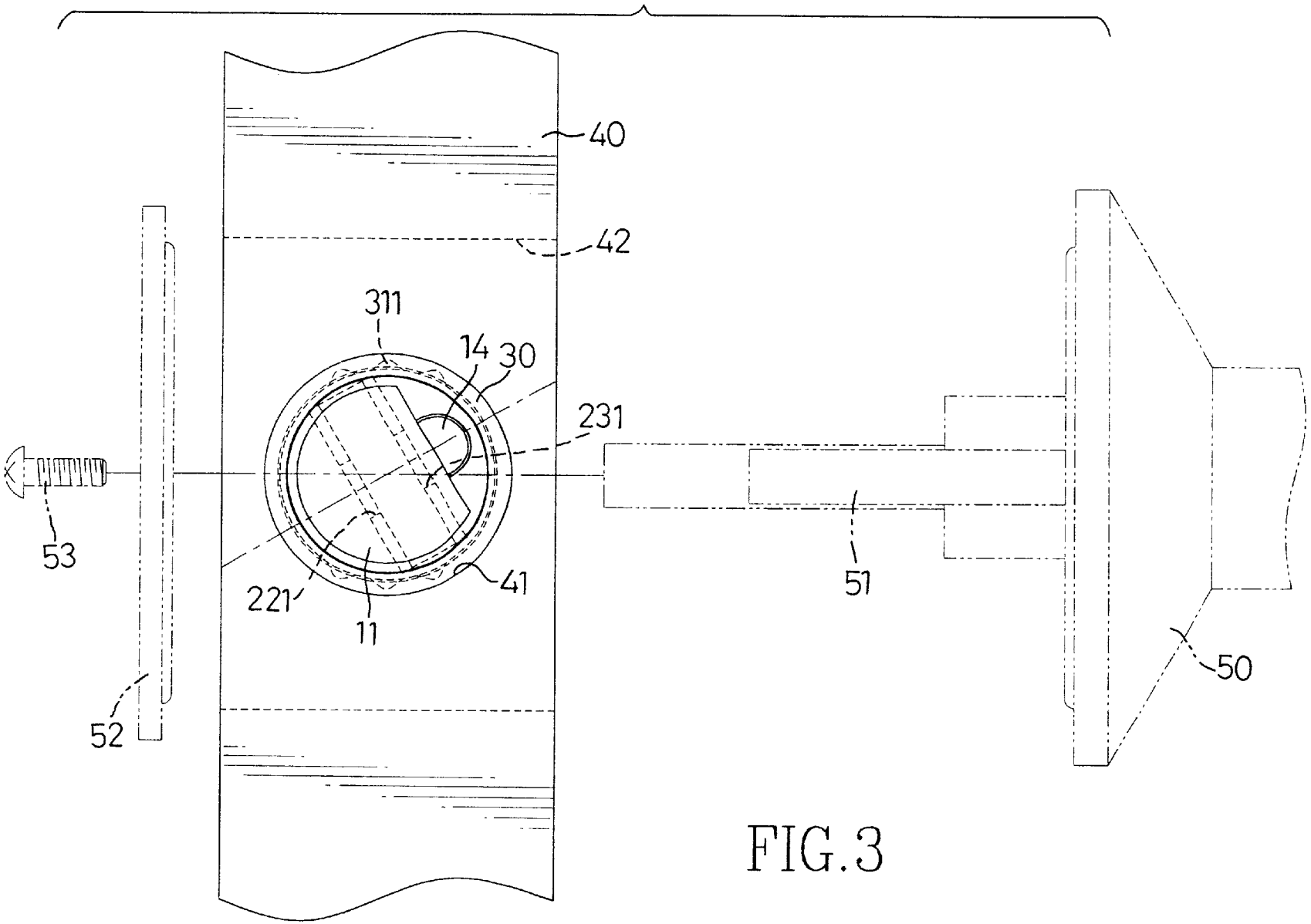
FIG. 3 is a side view showing that the tubular door lock is being adjusted during an installation.
Figure 4:
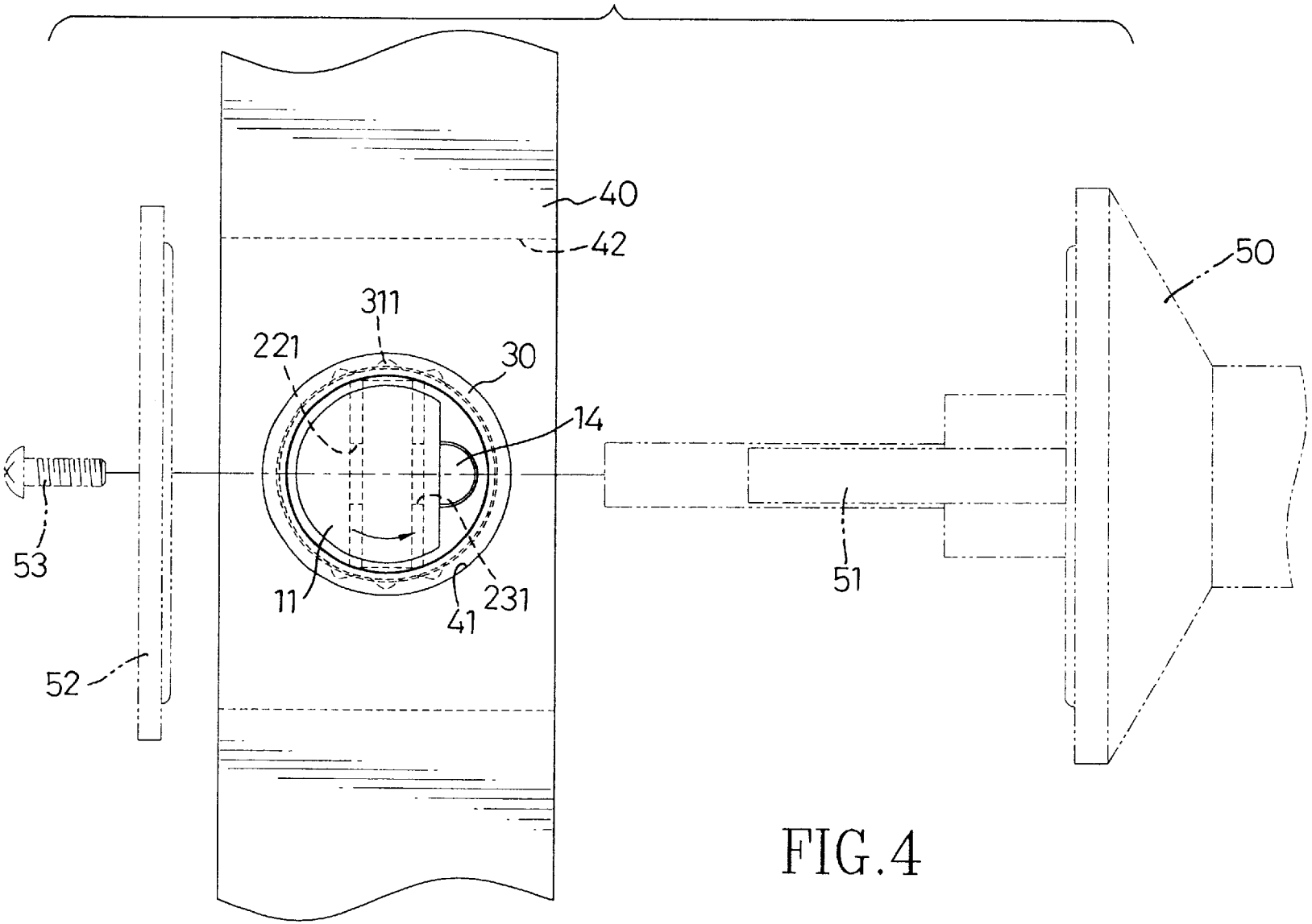
FIG. 4 is a side view showing that the tubular door lock has been adjusted.
Figure 5:
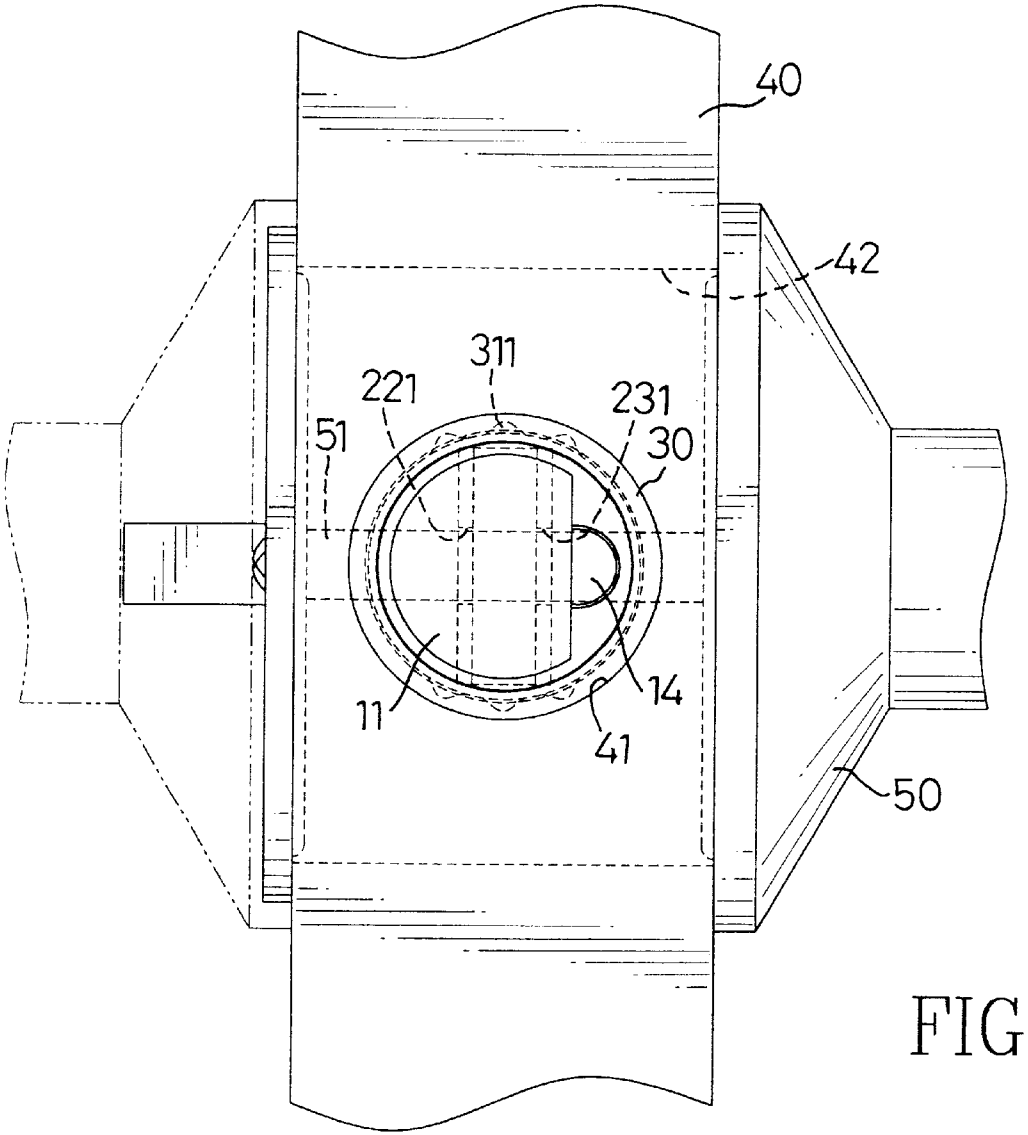
FIG. 5 is a side view showing that the tubular door lock has been installed on a door.
Figure 6:
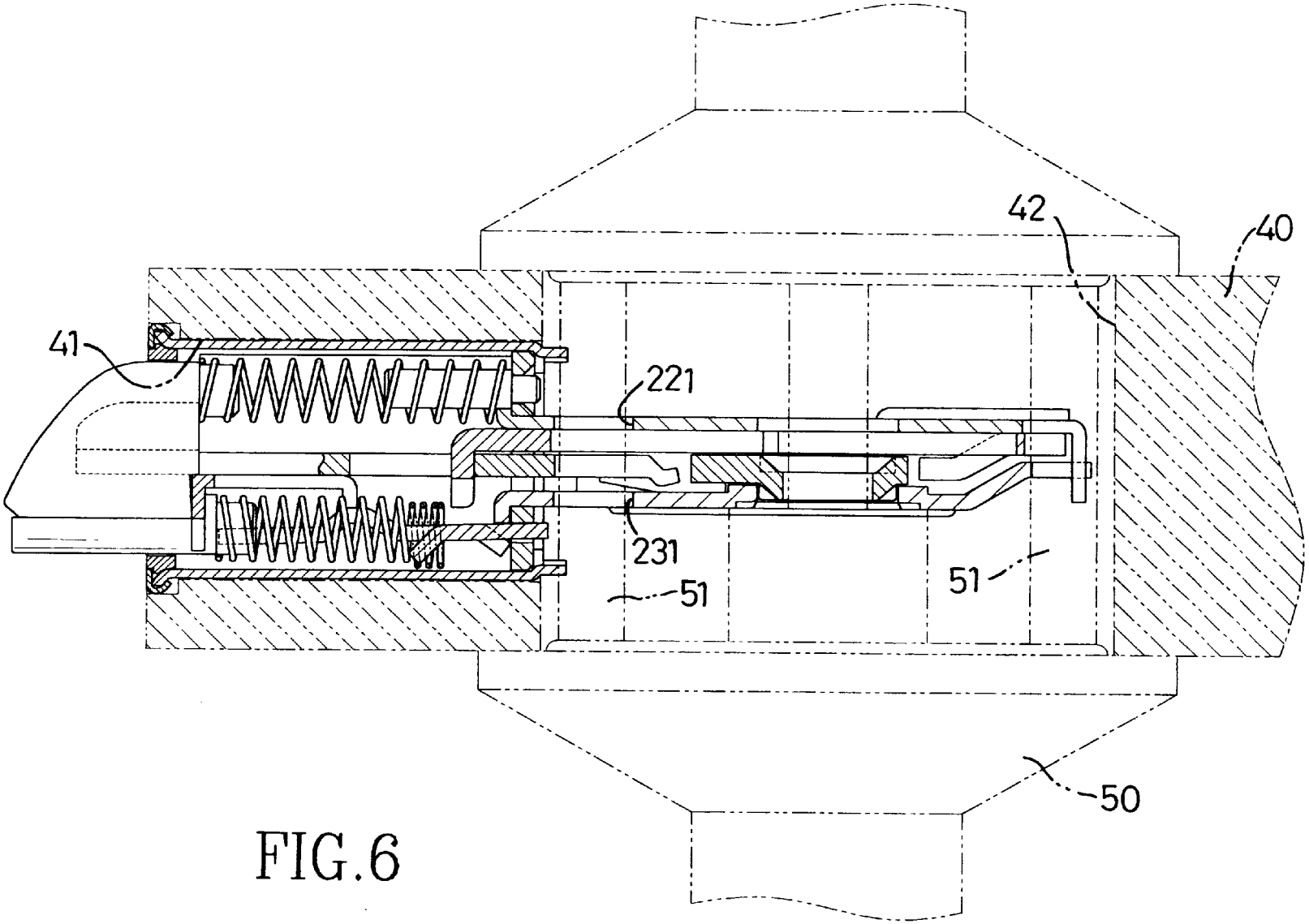
FIG. 6 is a cross sectional view of FIG. 5.
Figure 7:
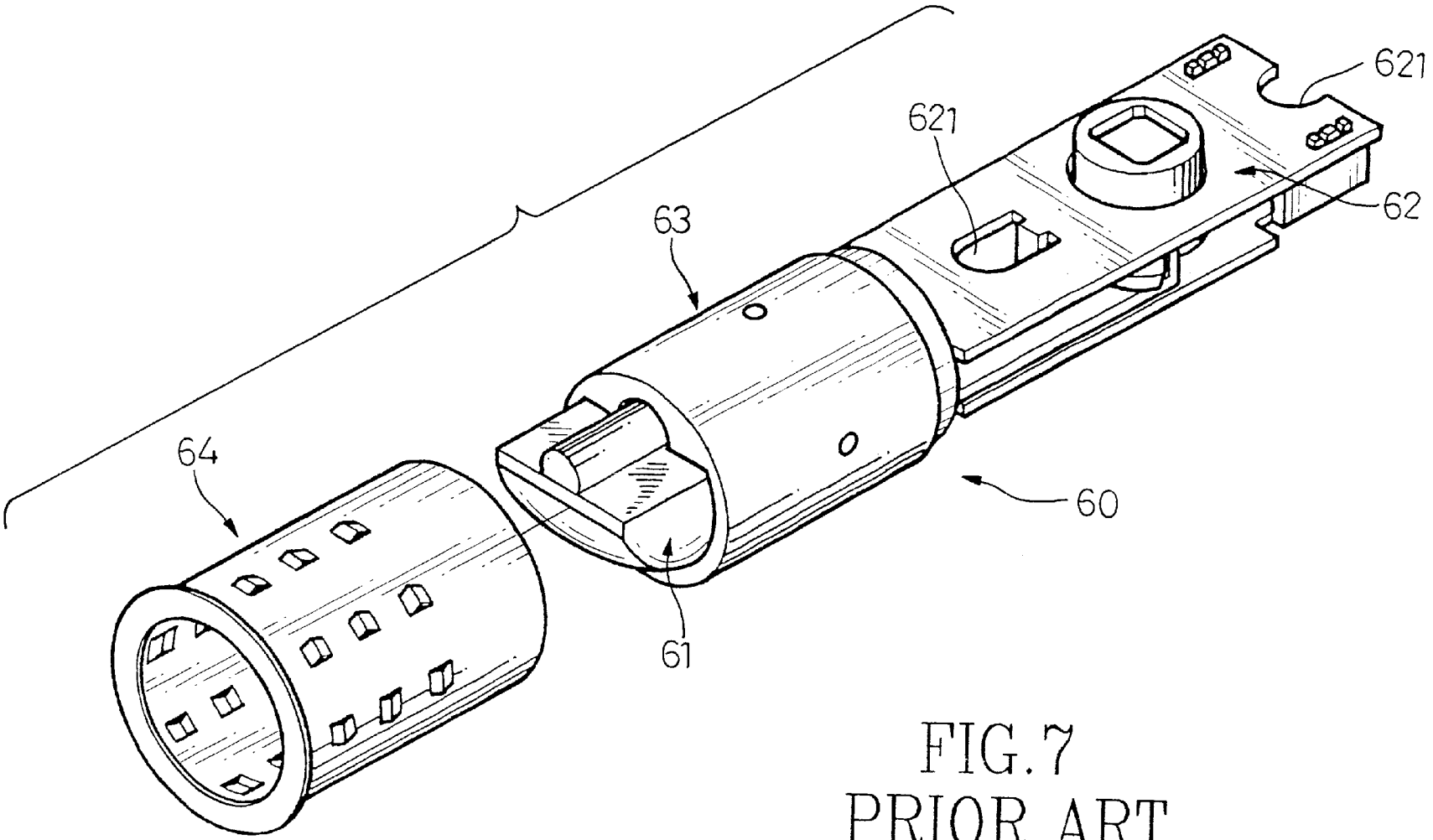
FIG. 7 PRIOR ART
FIG. 7 is an exploded view of a conventional door lock.
Figure 8:
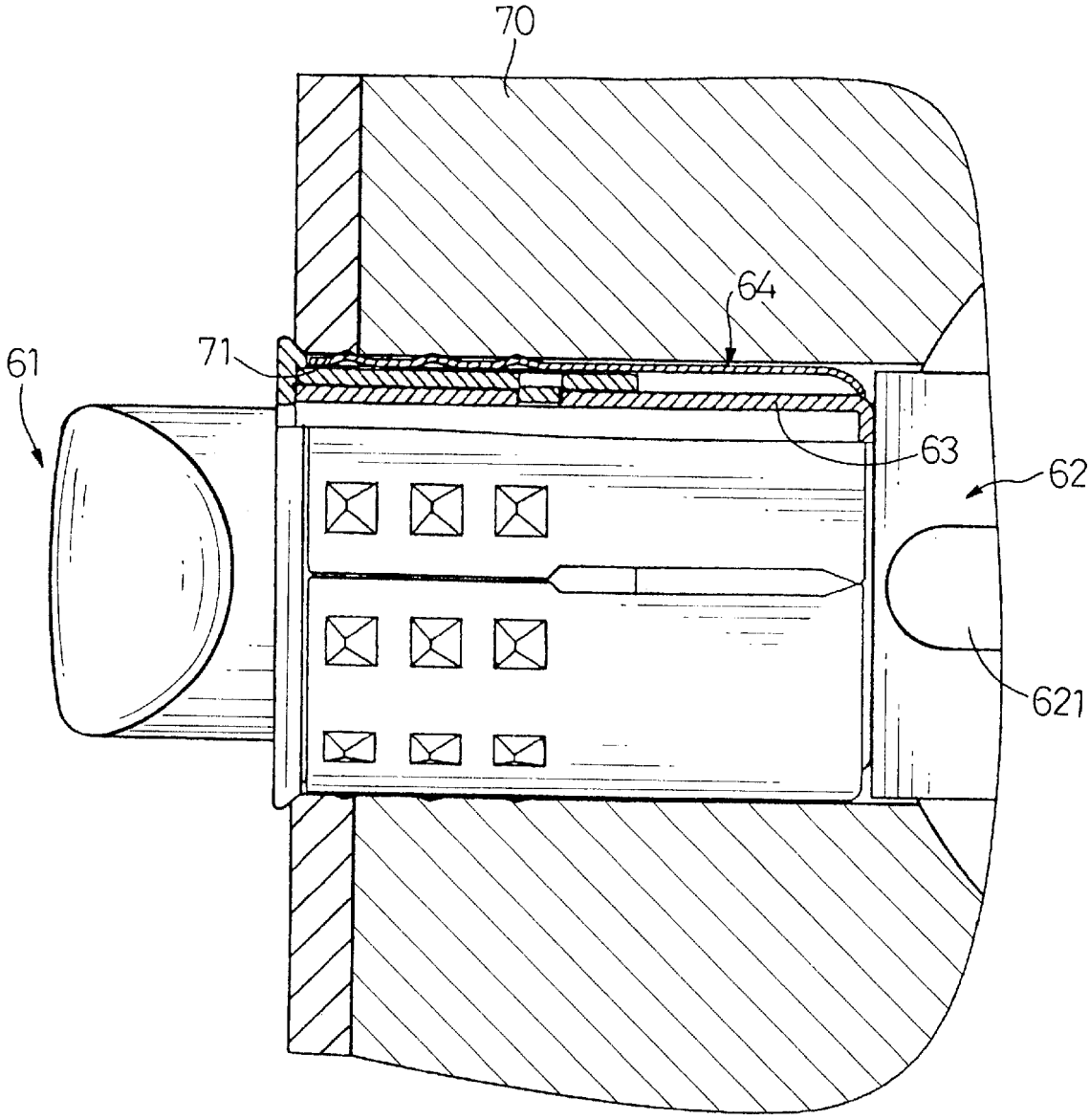
FIG.8 PRIOR ART
FIG. 8 is a cross sectional view of the conventional door lock.

Referring to FIGS. 2 and 3, during installation of a door lock on a door (40), the lock core of the invention is inserted in a lateral hole (41) in the door (40) without considering the angle of the latch part (20). The barrel (30) is securely mounted in the lateral hole (41) by the teeth (311) embedded in the door (40). The operating part (20) is located in a lockhole (42) perpendicular to the lateral hole (41). Referring to FIG. 4, either the latch part (10) or the operating part (20) is turned to make the positioning holes (221, 231) horizontal and aligned to the lockhole (42). In this case, the barrel (30) is stationary, so that it is very easy and convenient to adjust the angle of the latch part (10) and the operating part (20). Thereafter, referring to FIGS. 4–6, a lock body (50), which is mounted on an outer surface of the door (40), has a shaft (51) inserted through the lockhole (42) and the positioning holes (221, 231). A back cover (52) is mounted on an inner surface of the door (40) and fastened by a screw (53) engaged at a distal end of the shaft (51). The installed door lock is shown in FIG. 6.

From the above description, it is noted that the invention has the following advantages:

1. The latch part (10) and the operating part (20) are rotatable about the barrel (30), so that it is very convenient to install the door lock.
2. Because this design is based on a conventional structure and there is no additional element in the new structure, the door lock has a low cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A door lock core comprising:

a latch part (10), the latch part (10) having a disk (17) with a slot (171) defined through a central portion of the disk (17) and a first aperture (172) defined at a first side of the slot (171), the disk (17) having a front side and a rear side, a rod (12) mounted in the first aperture (172) at the front side, a first latch plate (13) extending through the slot (171) and having an opening (131) defined therein, a latch bolt (11) located at the front side of the disk (17) and having a hole (112) to receive a front end of the first latch plate (13), a slope formed at an outer end of latch bolt (11) and a pole (111) formed at an inner end of the latch bolt (11) and in alignment with the rod (12), and a first resilient member (113) provided between the pole (111) and the rod (12);

an operating part (20) located at the rear side of the disk (17), the operating part (20) having a pull plate (21) extending through the slot (171) and having a first hook (211) formed at a front end of the pull plate (21) and attached in the opening (131) of the first latch plate (13), a first side plate (22) and a second side plate (23) assembled together to cover the pull plate (21) between the two side plates (22, 23), the first side plate (22) having a first positioning hole (221) defined therein and a second hook (222) attached in the slot (171), the second side plate (23) having a second positioning hole (231) in alignment with the first positioning hole (221) and a third hook (232) attached in the slot (171), and a cam (24) mounted between the side plates (22, 23);

a barrel (30), the barrel (30) having a tubular body (31) to receive the latch part (10) therein, a flange (312) formed at a rear end of the tubular body (31) and the disk (17) abutted the flange (312) and rotatable about the tubular body (31), a ring (32) with a through hole (321) rotatably mounted at a front end of the tubular body (31) and the latch bolt (11) extending out the through hole (321), and a collar (33) securely mounted outside the ring (32) to prevent the ring (32) escaping, whereby, during installation, the barrel (30) is secured in a door, and the latch part (10) and the operating part (20) can be adjusted about the barrel (30).

2. The door lock core as claimed in claim 1, wherein the latch part (10) further has a dead bolt (14) parallel to the latch bolt (11) and mounted on a second latch plate (15) abutting the first latch plate (13), the disk (17) has a second aperture (173) defined at a second side opposite to the first aperture (172) and in alignment with the dead bolt (14), a third latch plate (16) is mounted in the second aperture (173) at the front side and has two long arms (162) extending forwards and a butt (161) formed between the arms (162), and a second resilient member (142) is provided between the dead bolt (14) and the butt (161).

3. The door lock core as claimed in claim 2, wherein the dead bolt (14) has a recess (141) defined at a rear end thereof, the second latch plate (15) has an ear (151) with a notch (152), the dead bolt (14) is mounted in the ear (151) with the recess (141) received in the notch (152).

4. The door lock core as claimed in claim 1, wherein the slot (171) of the disk (17) is defined as an "I".

* * * * *